US005887409A

United States Patent [19]

Leal Pereira Da Silva

[11] Patent Number: 5,887,409

[45] Date of Patent: Mar. 30, 1999

[54] PROCESS FOR VACUUM PACKAGING OF MATERIALS

[75] Inventor: Carlos Alberto Leal Pereira Da Silva, Randburg, South Africa

[73] Assignee: Van Leer South Africa (Proprietary) Limited, Parktown, South Africa

[21] Appl. No.: 750,661

[22] PCT Filed: Jun. 19, 1995

[86] PCT No.: PCT/GB95/01435

§ 371 Date: Feb. 18, 1997

§ 102(e) Date: Feb. 18, 1997

[87] PCT Pub. No.: WO95/35239

PCT Pub. Date: Dec. 28, 1995

[30] Foreign Application Priority Data

Jun. 20, 1994 [ZA] South Africa ..... 94/4365
Apr. 24, 1995 [ZA] South Africa ..... 95/3295

[51] Int. Cl.[6] ..... B65B 31/00

[52] U.S. Cl. ..... 53/434; 53/542; 53/469; 53/481; 53/284.7; 53/374.8

[58] Field of Search ..... 53/434, 469, 479, 53/481, 512, 122, 284.7, 527, 373.6, 374.8, 373.7

[56] References Cited

U.S. PATENT DOCUMENTS

| | | | |
|---|---|---|---|
| 2,235,394 | 3/1941 | Berch | 53/512 |
| 3,103,771 | 9/1963 | Grafingholt | 53/512 X |
| 3,968,629 | 7/1976 | Gidewall et al. . | |
| 4,404,788 | 9/1983 | Svenäng . | |
| 4,473,989 | 10/1984 | Tsutsumi et al. | 53/284.7 X |
| 4,706,441 | 11/1987 | Chervalier | 53/512 |
| 4,798,039 | 1/1989 | DeGlise | 53/434 X |
| 4,817,365 | 4/1989 | Yawberg et al. | 53/434 X |
| 4,845,927 | 7/1989 | Rapparini | 53/512 X |
| 5,220,768 | 6/1993 | Aarts | 53/434 X |

FOREIGN PATENT DOCUMENTS

| | | | |
|---|---|---|---|
| 0 056 701 | 7/1982 | European Pat. Off. . | |
| 912597 | 3/1982 | U.S.S.R. | 53/512 |
| 87/03555 | 6/1987 | WIPO . | |

OTHER PUBLICATIONS

*ICA Profile,* ICA, S.p.A.

*Primary Examiner*—Linda Johnson
*Attorney, Agent, or Firm*—Bell Seltzer Intellectual Property Law Group of Alston & Bird LLP

[57] ABSTRACT

A method of packaging a particulate material is provided. The method includes the steps of providing a flexible plastic bag having an opening at one end, placing the bag in a mold which generally takes the form of an open-topped box, introducing the material into the bag through the opening, creating a vacuum in the bag and sealing the bag to close the opening while maintaining the vacuum in the bag.

3 Claims, 2 Drawing Sheets

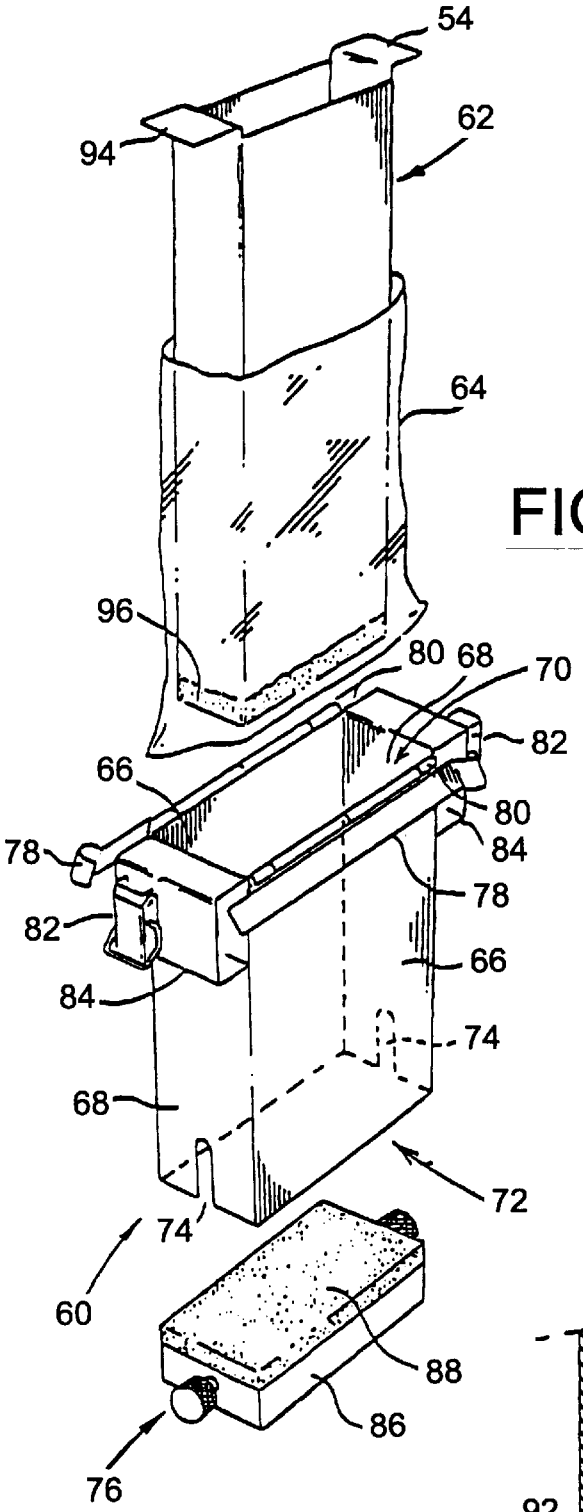
FIG. 7.
FIG. 8.
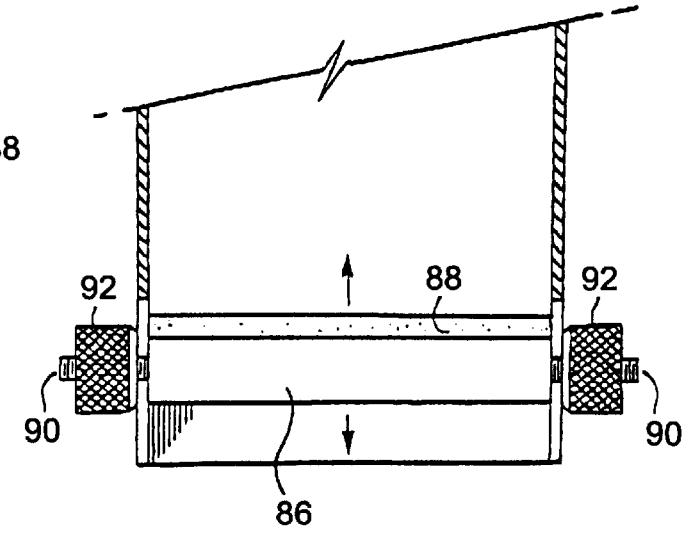

PROCESS FOR VACUUM PACKAGING OF MATERIALS

BACKGROUND OF THE INVENTION

This invention relates to a method of packing a particulate material.

Nuts such as cashew nuts are generally packed in metal drums for transport around the world. The nuts are introduced into the drums through an opening. The opening is closed and the nuts then purged with a gas such as carbon dioxide. Although the drums are robust, this method of packing nuts does give rise to several problems. There is inevitably some ullage space in the drum allowing the nuts to move during transport and this movement can cause attrition of the nuts. The shelf-life of the nuts packed in this way is, at best, six to eight months. Metal containers are expensive and relatively heavy.

SUMMARY OF THE INVENTION

According to the present invention, a method of packing a particulate material includes the steps of providing a flexible bag having an opening, placing the bag in a mould, introducing the material into the bag through the opening, creating a vacuum in the bag, sealing the bag to close the opening while maintaining the vacuum in the bag, and removing the bag from the mould.

The method of the invention has particular application for the packaging of particulate material which is in dry flowable form. An example of such a material is a foodstuff such as nuts. Other materials which may be packaged are finely particulate, granular or powder materials such as fertilisers or pharmaceutical products such as tablets, capsules or the like.

The method of the invention may be used for packing a plurality of block-shaped, filled bags in a container. This may be achieved by producing a plurality of block-shaped filled bags as described above, and then packing these bags in a container which is suitably shaped to receive these bags. For example, the container may be rectangular or block shaped allowing the packing of the bags therein with little or no wasted space.

According a preferred form of the mould, it comprises an open topped box defining a cavity for receiving the bag, a peripheral edge defining the open top, slits formed in the peripheral edge on opposite sides of the box, and a lid, in two sections, each section being moveable between a first position in which it is removed from the open top and a second position in which it closes a portion of the open top, the sections in this position leaving a gap substantially in register with the slits adapted to accommodate the bag, in collapsed form.

The mould may include an adjustable base allowing the volume thereof to be varied to cater for variation in size and/or density of a packed bag produced therein.

DESCRIPTION OF THE DRAWINGS

FIG. 7 is an exploded view of another embodiment of the mould of the invention, and FIG. 8 is a cross-section through the base of the mould shown in FIG. 7, with an adjustable base in place.

DESCRIPTION OF EMBODIMENTS

Figure 1:
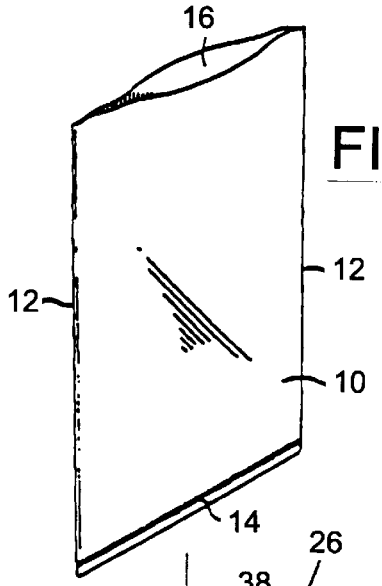
FIGS. 1 to 4 illustrate the sequence of steps in an embodiment of the method of the invention.

The method of the invention provides an efficient and effective means of packing particulate materials. The vacuum which is created in the bag ensures that the contents thereof are held in essentially fixed and immovable form. The presence of a vacuum, generally such as to allow for no more than 0,1 percent by mass oxygen, ensures that the contents of the bag are maintained in an essentially oxygen-free atmosphere. It is possible, while maintaining the vacuum, to introduce a minor amount of a purging gas such as carbon dioxide. The shelf-life of the foodstuff, for example, packed in the bag is enhanced.

The use of a mould allows for packed bags to be formed to a desired shape. Typically this shape will take the form of a block allowing the packed bag to be self-standing. A plurality of such bags may be processed and packed in a cardboard box leaving little or no wasted space.

The opening in the bag will generally be provided at an end thereof.

The bag will typically be a flexible plastic bag. Examples of suitable plastics are low density polyethylene and low density polyethylene co-extruded with a barrier layer which is substantially impervious to oxygen. A particularly suitable bag is one which comprises at least two layers of low density polyethylene co-extruded with a barrier layer sandwiched therebetween. The barrier layer may be a layer of polyamide.

The wall thickness of the bag will vary according to the size of the bag and the nature of the material being packed therein. The thickness will generally be less than 250 microns.

Sealing of the bag will typically be achieved by means of heat, alone or in combination with pressure. Standard heat impulse sealing apparatus may be used.

An embodiment of the invention will now be described with reference to the accompanying drawings. FIGS. 1 to 4 illustrate the various steps involved in packing a flexible polyethylene bag with nuts. Referring to these drawings, a flexible polyethylene bag 10 is provided. The bag 10 has elongate sides 12, a closed end 14 and an open end 16. The bag is dimensioned to be received by a mould.

The mould comprises a rectangular-shaped box 18 having major side surfaces 20, side surfaces 22 joining the major side surfaces 20 and an end 24 (not shown). The box has an open top 26. The top edges 28 of the sides 22 have slits 30 formed therein. The slits 30 each have a wide section 32 and a narrow section 34. The top edges of the sides 20 each have one section 36 a lid hinged at 38 to it. The lid sections 36 move between an open position illustrated by FIG. 1 and a closed position illustrated by FIG. 2. When in the closed position, as shown in FIG. 2, a gap is provided between the leading edges 40 of lid sections 36. The lid sections 36 may be releasably held in their closed positions by means of catches 42.

The bag 10 is placed in the box 18 and the edges 12 of the bag engaged in the narrow sections 34 of the slits 30. The wide sections 32 of the slits 30 facilitate this engagement. Nuts are then poured into the bag through the open end 16 to fill the bag substantially to the level of the narrow sections 34 of the slits 30.

Thereafter, the lid sections 36 are rotated to their closed positions, as shown by FIG. 2, and the latches 42 engaged. In this position, the open end 16 of the bag protrudes beyond the lid sections 36. Engagement of the top end of the bag in the slits 30 and in the gap between the leading edges 40 of the lid sections 36 ensures that a substantially flat region 44 is presented outside of the box.

Figure 3:
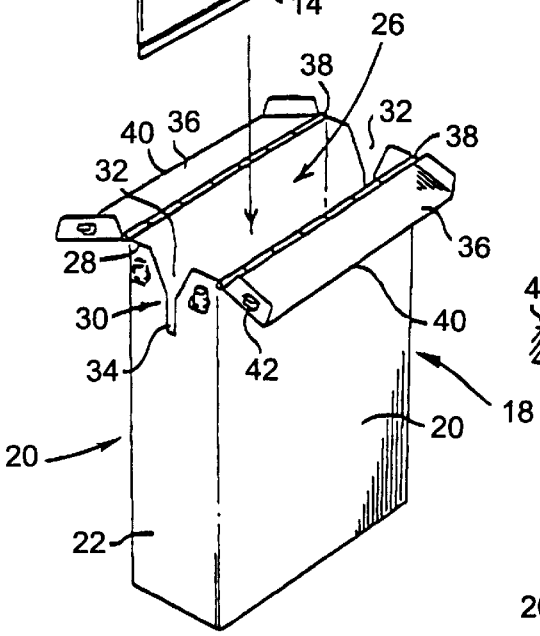
Figure 4:
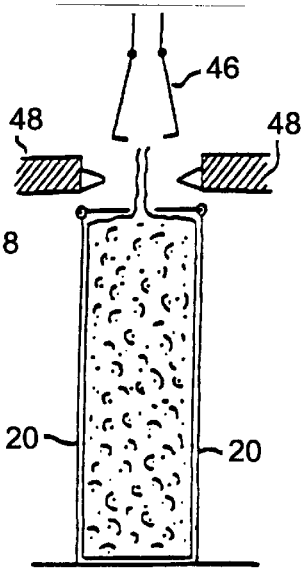

A vacuum-creating apparatus, shown diagrammatically at 46, is now brought into engagement with the open end 16 of the bag, as shown by FIG. 3. A vacuum is created in the bag and, while maintaining the vacuum, heating platens 48 are brought into contact with the bag, as shown by FIG. 4, to seal and close the open end 16 of the bag.

Figure 5:
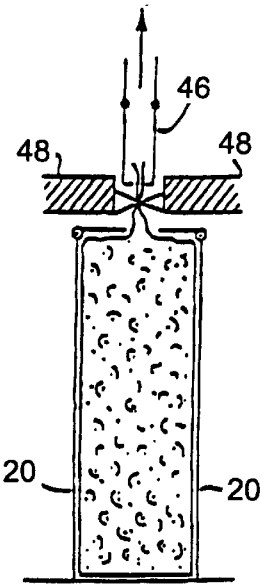
FIG. 5 is a perspective view of a bag packed with nuts according to the invention.

The latches 42 are disengaged, the lid sections 36 rotated to their open positions and the vacuum-packed bag withdrawn from the box. This vacuum-packed bag, sealed along line 50, is illustrated by FIG. 5.

Figure 6:
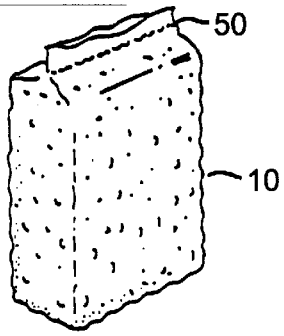
FIG. 6 is a perspective view of a box containing a number of the packed bags of FIG. 5.
Figure 6:
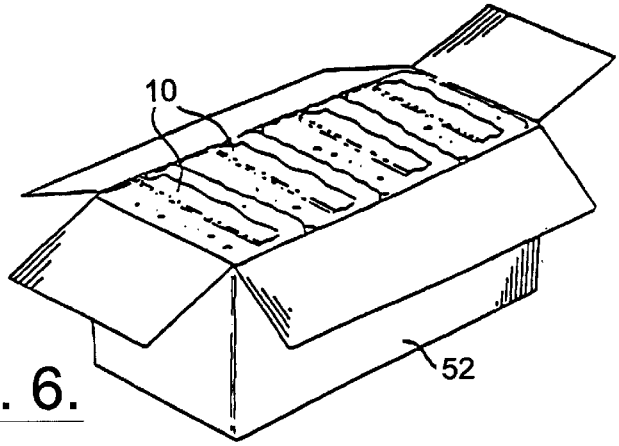

A plurality of these bags may now be processed simultaneously and then loaded into a box 52, generally a cardboard box, as shown by FIG. 6. The block shape of the moulded vacuum-packed bags allows them to fit neatly into the box.

The invention gives rise to several advantages over the prior art methods of packing nuts. First, the vacuum packing of the nuts ensures a long shelf-life of up to 60 months. It is possible to introduce a small quantity of carbon dioxide into the bag under the vacuum conditions. This has the effect of increasing the shelf-life of the nuts. Second, no movement of the nuts in the bag is possible, reducing the risk of damage to the nuts in transport. Third, a much larger quantity of nuts can be loaded into a standard container using this method than is the case with conventional metal drums. Fourth, each and every bag will be self-standing, facilitating group packaging and enhancing display properties.

The invention has particular application to the packing of cashew nuts. However, it may be used for the packing of other nuts such as pecan and macadamiun nuts and other foodstuffs.

Another embodiment of the invention is shown in FIGS. 7 and 8. Referring to these drawings, the apparatus comprises a mould 60, a chute 62 and a flexible polyethylene bag 64. The bag 64 is identical to the bag described above.

The mould 64 comprises a rectangular shaped tube having major side surfaces 66 and side surfaces 68 joining the major side surfaces 66. The side surfaces together define an open top 70 and an open bottom 72. The side surfaces 66 have upwardly extending slots 74 formed therein, to facilitate the adjustment of the base 76 of the mould. The top edges of the major sides 66 each have one section 78 of a lid hinged to it at 80. The sections 78 are pivotable between open and closed positions as described above and may be releasably held in their closed positions by means of clips 82. The clips 82 are mounted on ears 84 which extend from the side surfaces 68.

The base 76 of the mould comprise a rigid plate 86 and a layer of foam rubber 88. The layer of foam rubber 88 serves to distribute the forces exerted by the base on the contents of the bag 64 during the moulding process. Threaded rods 90 extend from opposite sides of the plate 86. A knurled fastener 92 is mounted on each rod 90. In use, the base 76 is inserted in the lower end 72 of the mould 60, with the rods 90 locating in the slots 74 as shown in FIG. 2. The position of the base can be adjusted within the limits imposed by the slots 74. This adjustment allows a variation in the volume of the mould and hence the size and/or density of the final packed bag. When the base 76 is in the desired position, the fasteners 92 are tightened against the sides 68 of the mould, thereby to hold the base 76 securely in place.

In this embodiment, chute 62 is used to facilitate the insertion of the bag 64 in the mould 60, and to facilitate the filling of the bag once in the mould. The chute 62 is in the form of a rectangular tube having dimensions slightly smaller than the open top 70 of the mould 60. The chute has laterally extending ears 94 which promote ease of handling of the chute. The lower edge of the tube may be coated with a rubber compound at 96 to prevent damage to the bag 64.

Figure 2:
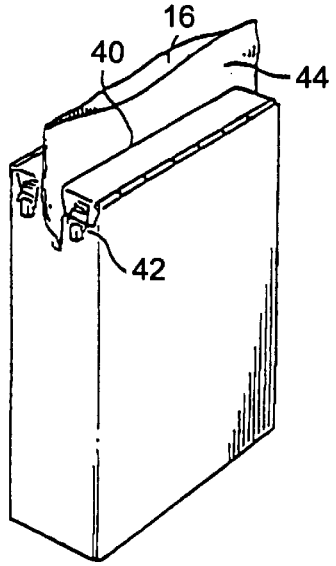

In use, once the base 76 has been fastened in place, the bag 64 is inserted over the chute 62 as shown in FIG. 1. The chute 62 is then inserted into the mould 60 via the open top 70 until the chute rests on the foam rubber layer of the base 76. When the chute is in this position, the bag 64 is held open adjacent to the sides of the mould 60, which ensures that the bag is filled quickly and efficiently. The desired amount of foodstuff is poured into the top of the chute 62, and the chute is withdrawn. The sections 78 of the lid are pivoted to their closed positions, with the end of the bag 64 protruding above the lid sections. The lid sections are fastened in place by means of the clips 82. A vacuum is then applied to the bag and the bag is sealed as described in the complete specification of patent application Ser. No. 94/4365.

Once the bag has been sealed, the clips 82 are released and the sections 78 of the lid are pivoted to their open position. The block shaped bag which has resulted from the moulding process can then be removed from the mould and packed side by side with similar block shaped bags in a box. This results in efficient utilisation of the space available in the box.

What is claimed is:

1. A mould, comprising:

a four-sided box defining a cavity for receiving a container, the box comprising a first peripheral edge defining an open top and a second peripheral edge defining an open bottom;

slits formed in the first peripheral edge on opposite sides of the box and extending a predetermined length in a downward direction away from the first peripheral edge;

slots formed in the second peripheral edge on opposite sides of the box and extending a predetermined length in an upward direction away from the second peripheral edge;

a lid, in at least two sections, each section being movable between a first open position, and a second closed position in which it closes at least a portion of the open top, the sections in the closed position combining to create a gap substantially in register with the slits adapted to accommodate the container in collapsed form; and an adjustable base for varying the volume of the mould, the adjustable base comprising a rigid plate having outwardly extending rods received by the slots formed in the second peripheral edge, and a lock to releasably orient the base in a desired position.

2. The mould according to claim 1, wherein the rods are threaded and the lock comprises knobs located on the rods and adapted to be screwed to secure the base to the mould.

3. A method for packing a container with a particulate material, comprising the steps of:

providing a box-shaped mould comprising a first peripheral edge defining an open top and a second peripheral edge defining an open bottom, said mould further comprising a lid, in two sections, a cavity for receiving the container, slits on opposite sides of the cavity adapted to engage the upper edges of the container, slots formed in the second peripheral edge on opposite sides of the mould, and an adjustable base comprising a rigid plate having outwardly extending rods received by the slots formed in the second peripheral edge and a lock for releasably orienting the base in a desired position;

orienting the container into the mould;

introducing particulate material into the container;

applying a vacuum to the container;

closing the lid sections of the mould to hold the opening of the container between said lid sections to present a substantially flat sealing surface;

sealing the container under vacuum; and removing a box-shaped container from the mould.

* * * * *